US009375969B2

(12) United States Patent
Mueller

(10) Patent No.: US 9,375,969 B2
(45) Date of Patent: Jun. 28, 2016

(54) METHOD AND DEVICE FOR EXCHANGING AN ADHESIVE APPLICATION ROLLER

(71) Applicant: Mueller Martini Holding AG, Hergiswil (CH)

(72) Inventor: Hans Mueller, Lauda-Koenigshofen (DE)

(73) Assignee: MUELLER MARTINI MARKETING AG, Hergiswil (CH)

( * ) Notice: Subject to any disclaimer, the term of this patent is extended or adjusted under 35 U.S.C. 154(b) by 115 days.

(21) Appl. No.: 13/779,345

(22) Filed: Feb. 27, 2013

(65) Prior Publication Data

US 2013/0230368 A1 Sep. 5, 2013

(30) Foreign Application Priority Data

Feb. 29, 2012 (CH) ..... 0276/12

(51) Int. Cl.

| | |
|---|---|
| ***B42C 9/00*** | (2006.01) |
| ***B42C 13/00*** | (2006.01) |
| ***B42C 17/00*** | (2006.01) |
| ***B42C 11/02*** | (2006.01) |
| ***B42C 5/00*** | (2006.01) |

(52) U.S. Cl.

CPC ..... *B42C 9/00* (2013.01); *B42C 9/0012* (2013.01)

(58) Field of Classification Search

CPC ..... B42C 9/00; B42C 13/00; B42C 17/00; B42C 11/02; B42B 5/00

USPC ..... 412/9, 12, 15, 19, 33, 37, 901

See application file for complete search history.

(56) References Cited

U.S. PATENT DOCUMENTS

| | | | | |
|---|---|---|---|---|
| 1,741,269 | A | 12/1929 | Alger | |
| 5,443,639 | A | 8/1995 | Hawkes | |
| 6,056,494 | A * | 5/2000 | Fong et al. | 412/37 |

(Continued)

FOREIGN PATENT DOCUMENTS

| | | |
|---|---|---|
| CH | 541438 A | 9/1973 |
| CN | 1075916 | 9/1993 |
| CN | 1289043 | 3/2001 |

(Continued)

OTHER PUBLICATIONS

International Search Report of CH 2762012 dated May 9, 2012 with an English Translation.

(Continued)

*Primary Examiner* — Alexander P Taousakis
*Assistant Examiner* — Justin V Lewis
(74) *Attorney, Agent, or Firm* — FisherBroyles, LLP

(57) ABSTRACT

A method and apparatus for exchanging an application roller which is aligned with a duct roller used to apply glue to a spine of a book block by rolling off the book block spine. The duct roller removes glue from a glue container to transfer glue to the application roller. At least two application rollers are arranging spaced apart, relative to each other, with one of the application rollers being positioned aligned and in contact with the duct roller. The duct roller and the at least two application rollers each have an axis of rotation that is positioned substantially normal to the conveying direction. The application rollers are moved in an axial direction with the aid of an exchanging device, such that a second one of the application rollers is moved into alignment with and against the duct roller in place of the first application roller.

14 Claims, 6 Drawing Sheets

(56) References Cited

U.S. PATENT DOCUMENTS

| | | | | |
|---|---|---|---|---|
| 2003/0198534 | A1* | 10/2003 | Valentinis | 412/9 |
| 2010/0209215 | A1* | 8/2010 | Sasamoto et al. | 412/37 |

FOREIGN PATENT DOCUMENTS

| | | | |
|---|---|---|---|
| CN | 1406761 | | 4/2003 |
| DE | 2320453 | A1 | 11/1973 |
| DE | 3502733 | C1 | 2/1986 |
| DE | 4332039 | A1 | 3/1995 |
| DE | 19906634 | A1 | 8/2000 |
| EP | 0873882 | A1 | 2/1998 |

OTHER PUBLICATIONS

P.R. China Office Action of China Application No. 201310063502.4 filed Sep. 6, 2015 with an English Translation.

* cited by examiner

METHOD AND DEVICE FOR EXCHANGING AN ADHESIVE APPLICATION ROLLER

CROSS-REFERENCE TO RELATED APPLICATION

This application claims the priority of Swiss Patent Application with No. 00276/12, filed on Feb. 29, 2012, the subject matter of which is incorporated herein by reference.

BACKGROUND OF THE INVENTION

The invention relates to a method and apparatus for exchanging or switching an application roller which is used to apply glue to a book block spine, that is transported in a conveying direction, by rolling off the book block spine, and which application roller is arranged to be aligned with a duct roller that removes glue from a glue container. For this exchange, a first application roller that makes contact with the duct roller is swiveled away from the duct roller, is then exchanged for a second application roller. This second application roller is subsequently swiveled back against the duct roller, wherein the first and the second glue application rollers have a joint drive shaft and wherein the duct roller and the joint drive shaft for the application rollers have separate rotational axes which are arranged substantially normal to the book block conveying direction. The invention furthermore relates to a book production line equipped with such a apparatus.

For book production, book blocks still lacking a book cover are conveyed with a transporting device while an application roller that operates jointly with a duct roller rolls off the book block spine, thereby applying glue to the spine. The spine contour can be flat or rounded, thus requiring the use of a correspondingly embodied application roller. Known application rollers, for example, are embodied either flat or profiled.

These or similar methods and devices can be deduced from the European patent document EP0873882 A1 and German patent documents DE3502733 C1 and DE4332069 A1.

The known methods provide for a manual exchange of the application roller. Thus, if a new production order calling for a book format that deviates from the previously used book format is received, the book production line must be stopped for safety-technical reasons since the roller exchange, meaning the removal and/or installation of the application roller, can be realized only while the casing is open. For that reason, the machine is stopped following the application of glue to the spine of the last book block belonging to the previous production order. Once the casing is opened, the currently used application roller is uninstalled and an application roller installed which corresponds to the new production order. In the process, the application roller is manually moved away from the duct roller and is then removed by hand. Subsequently, the new application roller is pushed onto the drive shaft, secured in place and then moved back again toward the duct roller with the aid of an adjustment mechanism. Following the closing of the casing, the production can resume and the new production order can be completed.

The known methods and devices are therefore relatively time-consuming and additionally require a manual intervention by operating personnel. In particular when producing small editions, a relatively high share of the time is required for the switching operation.

SUMMARY OF THE INVENTION

It is therefore an object of the present invention to provide a method and a apparatus for exchanging a glue application roller which permit a faster and less time-consuming exchange of the application rollers without any manual intervention. In particular, this should be possible for the production of small editions.

The above and other objects are accomplished according to one embodiment of the invention, wherein there is provided a method for exchanging an application roller which is aligned with a duct roller having an axis of rotation and which is used to apply glue to a spine of a book block by rolling off the book block spine, wherein the book block is transported in a conveying direction and the duct roller removes glue from a glue container to transfer the glue to the application roller, the method comprising: arranging at least two application rollers spaced apart, relative to each other, with one of the at least two application rollers being positioned aligned and in contact with the duct roller, wherein the duct roller and the at least two application rollers each have an axis of rotation that is positioned substantially normal to the conveying direction; and moving the application rollers in an axial direction with the aid of an exchanging device, such that a second one of the application rollers is moved into alignment with and against the duct roller in place of the one application roller.

According to another aspect of the invention, there is provided an apparatus to exchange an application roller which is aligned with a duct roller having an axis of rotation and which is used to apply glue to a spine of a book block by rolling off the book block spine, the book block being transported in a conveying direction and the duct roller removing glue from a glue container to transfer the glue to the application roller, the apparatus comprising: at least two application rollers axially spaced apart, relative to each other, wherein a first one of the at least two application rollers is initially aligned and in contact with the duct roller, the at least two application roller each having an axis of rotation separate from the axis of rotation of the duct roller, and the axis of rotation respectively of the duct roller and each of the at least two application rollers is substantially normal to the conveying direction; and a device to exchange the first one of the application rollers aligned with the duct roller with a second one of the application rollers, wherein the device is configured to initially move the first one of the application rollers away from the duct roller and then to axially move the at least two application rollers to exchange the first application roller with a second one of the application rollers which is then moved into alignment with and back against the duct roller.

As a result of this design for the apparatus and the corresponding method, the exchange of the application rollers in the apparatus can be carried out without manual intervention and independent of the size of a production order.

According to one embodiment of the inventive method, the first application roller that is aligned with the duct roller is initially moved away from the duct roller. This is followed by the axial movement of the application rollers until a second application roller is aligned with the duct roller. Finally, the second application roller is moved against the duct roller.

A further embodiment of the method according to the invention provides that when moving the second application roller against the duct roller, a distance is adjusted between the rotational axis of the second application roller and the rotational axis of the duct roller as a result of the machine control issuing a signal for the adjustment distance of the second application roller. Specifying such an adjustment distance has proven advantageous for the automatic exchange of application rollers, so that books can be produced safely on an industrial scale. The contact pressure between the application roller and the duct roller is furthermore also adjusted during this operation, thereby resulting in a lower chance of errors during the adjustment.

According to a different embodiment, the apparatus is provided with an actuating or adjusting mechanism which is connected to at least one of the application rollers and is operatively connected to a machine control for the apparatus, by which the application rollers can be moved away from and toward the axis of rotation of the duct roller. With this adjustment mechanism, the application rollers are moved to the exchanging position, so that they can subsequently be moved back toward the duct roller. This movement option additionally makes it possible to limit the movement by using robust end stops.

According to a different embodiment of the inventive apparatus, the adjustment mechanism comprises two jointly operating adjustment elements. It may be advantageous if a first adjustment element of the adjustment mechanism has a pneumatic cylinder and a second adjustment element of the adjustment mechanism includes a spindle having an output-side end which is embodied to rest on a basic frame for the apparatus. These separate adjustment elements permit realizing a fast swiveling movement for the roller exchange operation as well as a precise adjustment of the axial spacing between the duct roller and the respective application roller.

The pneumatic cylinder for a different embodiment of the inventive apparatus has a first axis and the spindle a second axis, wherein these axes enclose a variable adjustment angle in a vertical plane along the conveying direction. As a result, the spindle can advantageously be moved together with the application rollers.

The application rollers of yet another embodiment of the inventive apparatus are arranged coaxial and such that they can be moved along the joint axis of rotation, thus advantageously making it possible to realize an apparatus with separate drive shafts for the application rollers.

According to a different embodiment of the inventive apparatus, the application rollers are arranged on a joint drive shaft, to be displaceable in a longitudinal direction, thereby ensuring an easy maintenance and process safety for this arrangement of the application rollers. As compared to known magazine-feed systems used in tool making, more compact designs are obtained in this way.

According to a different embodiment of the inventive apparatus, the application roller which is aligned with the duct roller is embodied such that it can be swiveled toward as well as away from the duct roller.

The inventive apparatus of yet another embodiment comprises a basic frame and a swivel frame with an axis of rotation and two legs, wherein the application rollers are positioned swiveling in the swivel frame and wherein a first leg of the swivel frame is connected to the first adjustment element and a second leg of the swivel frame is connected to the second adjustment element. Lever mechanisms of this type ensure a good reproducibility for automated sequences.

For a different embodiment of the inventive apparatus, at least one of the application rollers is embodied such that it can be admitted with compressed air. Using an application roller of this type makes it possible to utilize the apparatus for applying glue to a plurality of different spine formats.

The apparatus according to the invention may preferably be used as part of a book production line.

BRIEF DESCRIPTION OF THE DRAWINGS

These and other features and advantages of the invention will be further understood from the following detailed description with reference to the accompanying drawings, showing in.

DETAILED DESCRIPTION

Figure 2:
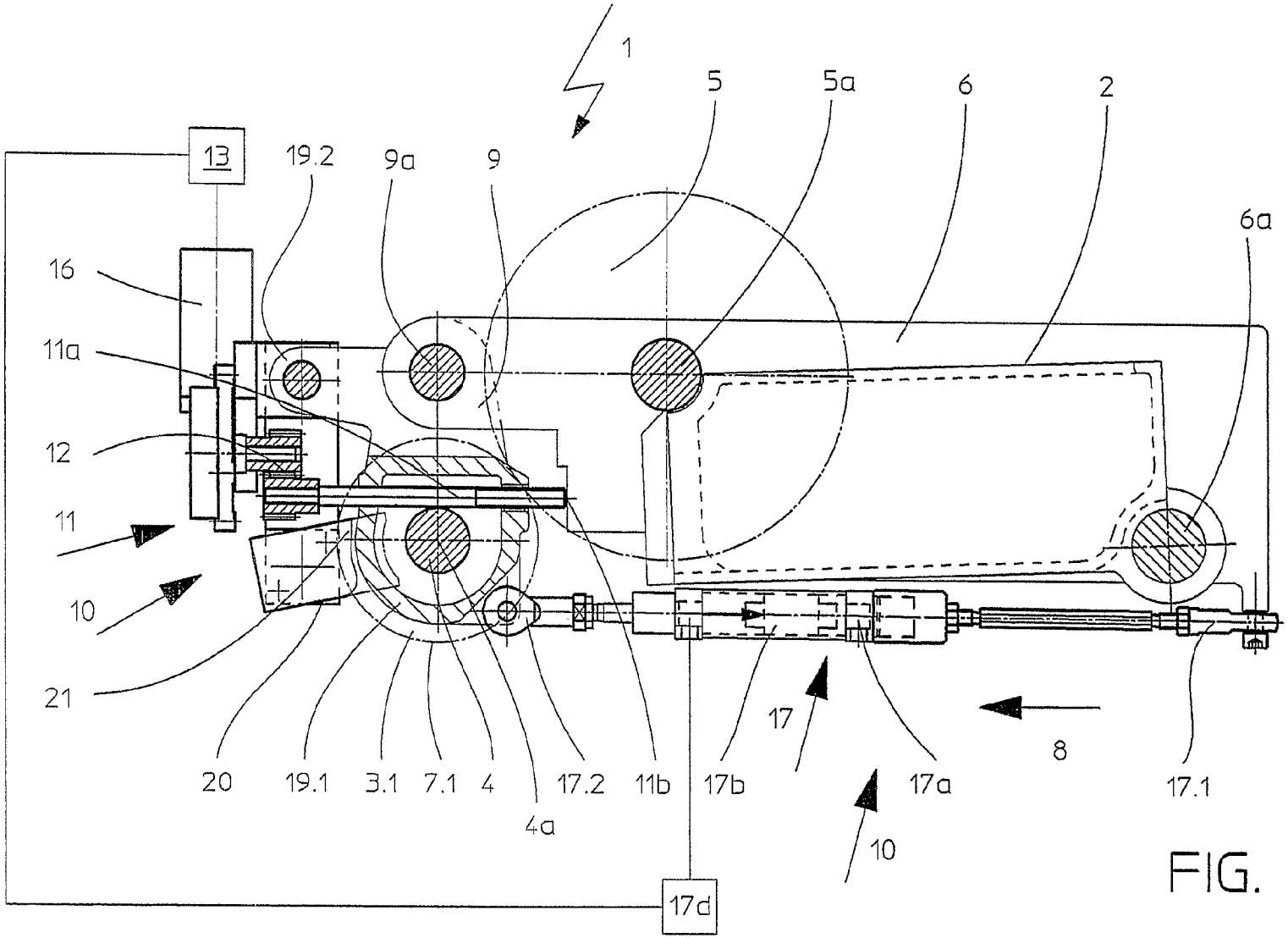
FIG. 2 A section along the line II-II in FIG. 1, wherein the first application roller is swiveled against the duct roller.

The Figures show a single exemplary embodiment of an apparatus 1 according to the invention for the mechanical application of glue to the spine of a book block. For this, the book block is transported in a manner known per se in a conveying direction 8 with the aid of a transport device, not shown herein, such that the spine is oriented in the conveying direction 8 (FIG. 2).

Figure 1:
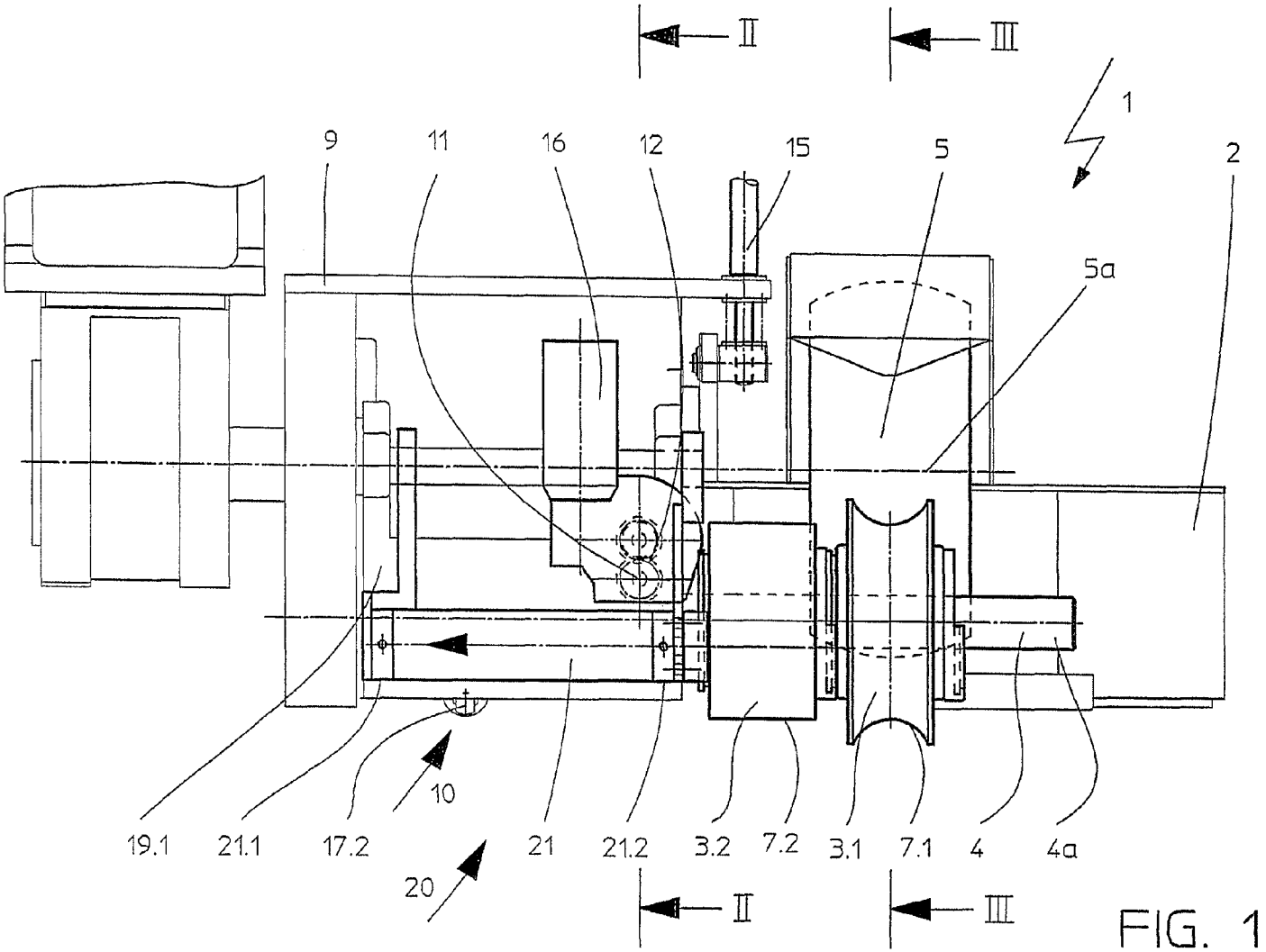
FIG. 1 A view of the front of an apparatus according to the invention, provided with a duct roller, a first application roller, and a device for the roller exchange, wherein a first application roller is aligned with the duct roller.

The apparatus 1 consists of a basic frame 6 (FIG. 2) with therein suspended glue container 2. Also positioned inside the basic frame 6 is a duct roller 5 with an axis of rotation 5*a* that is positioned normal to the conveying direction 8. Downstream of the duct roller 5, a first and a second application roller 3.1, 3.2 are arranged while spaced apart on a joint drive shaft 4 (FIG. 1). The application rollers 3.1, 3.2 can, of course, also be respectively arranged on a separate drive shaft.

Figure 3:
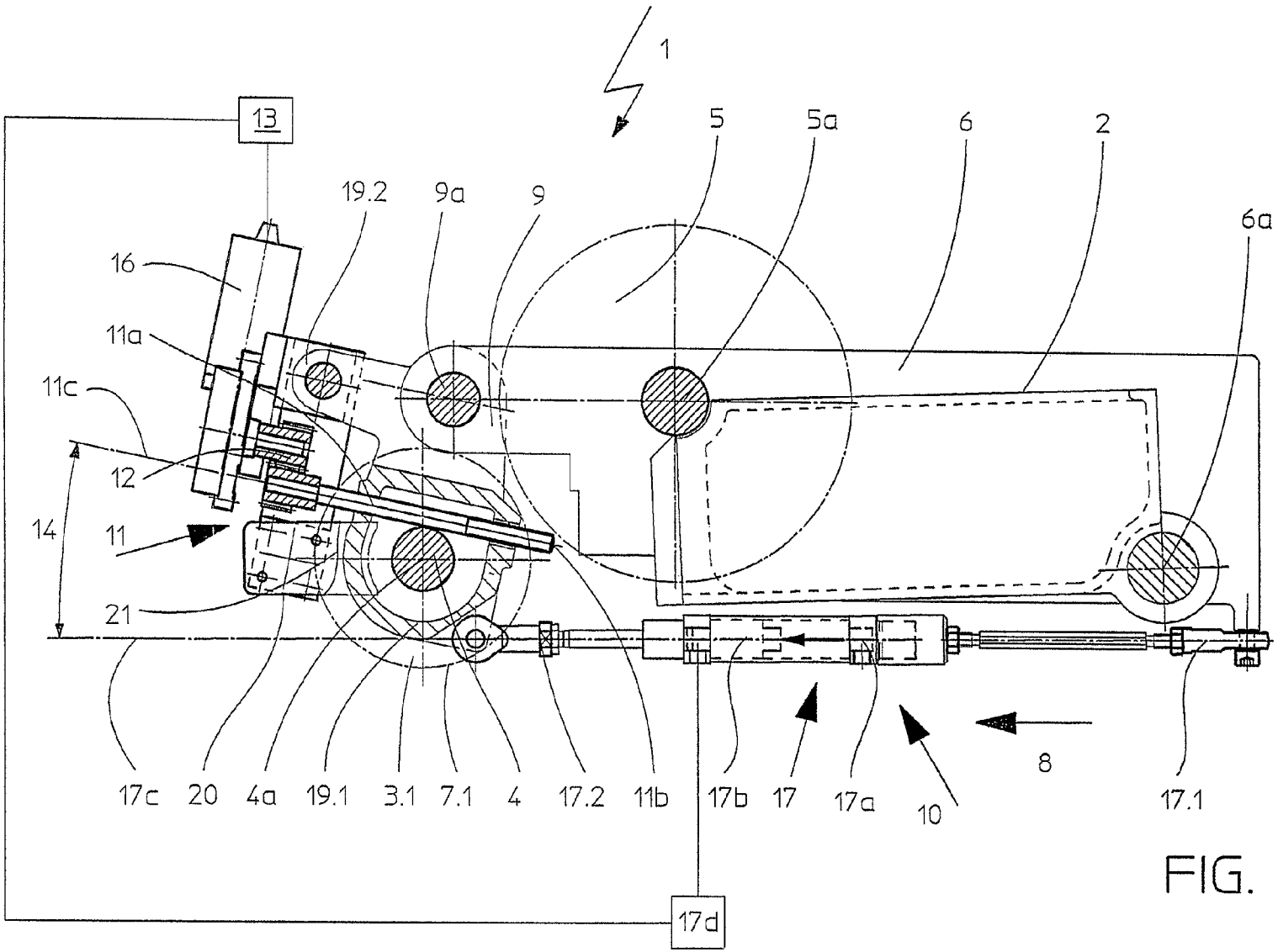
FIG. 3 A representation that corresponds to FIG. 2, wherein the first application roller is swiveled away from the duct roller.
Figure 4:
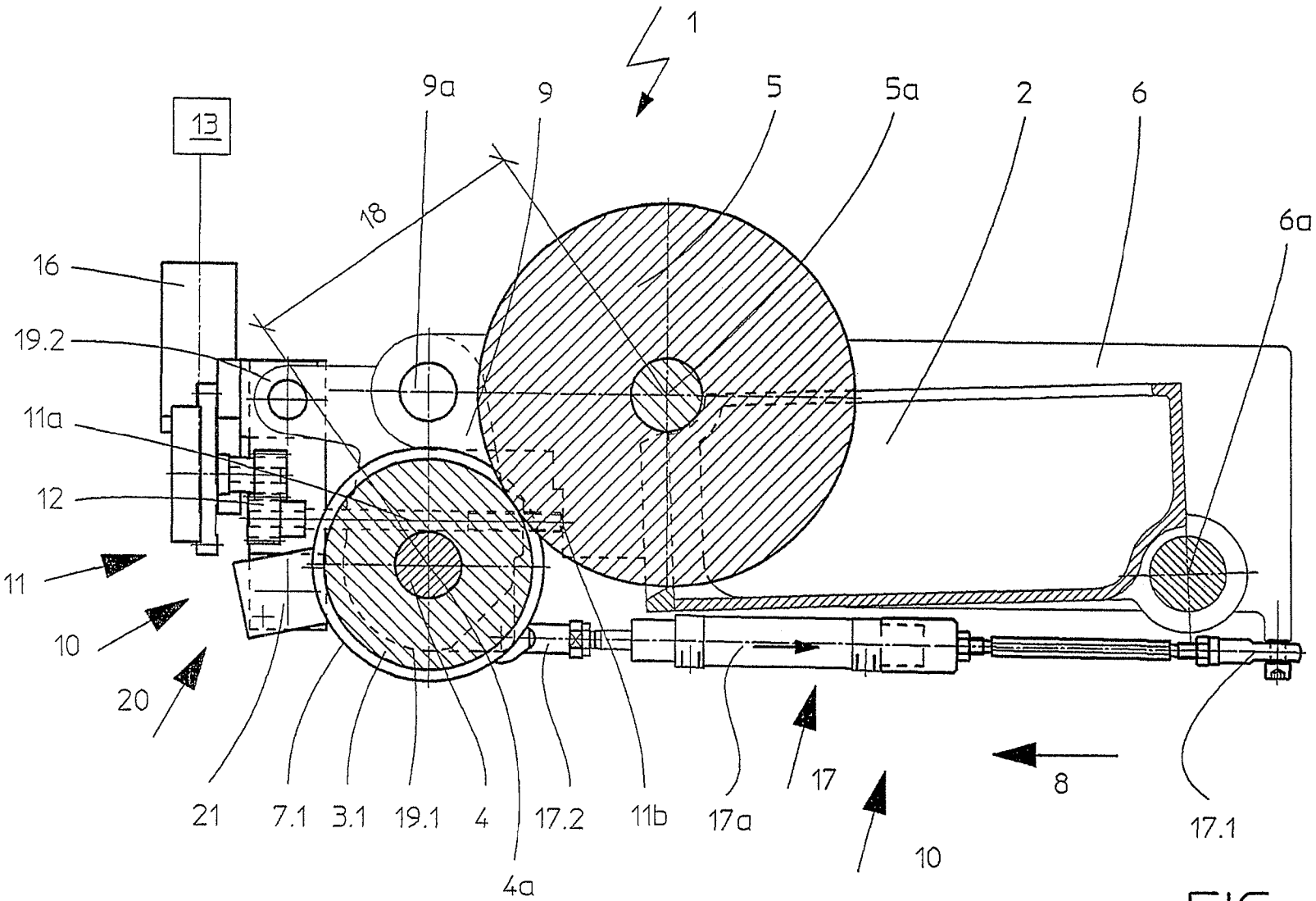
FIG. 4 A section along the line in FIG. 1.
Figure 5:
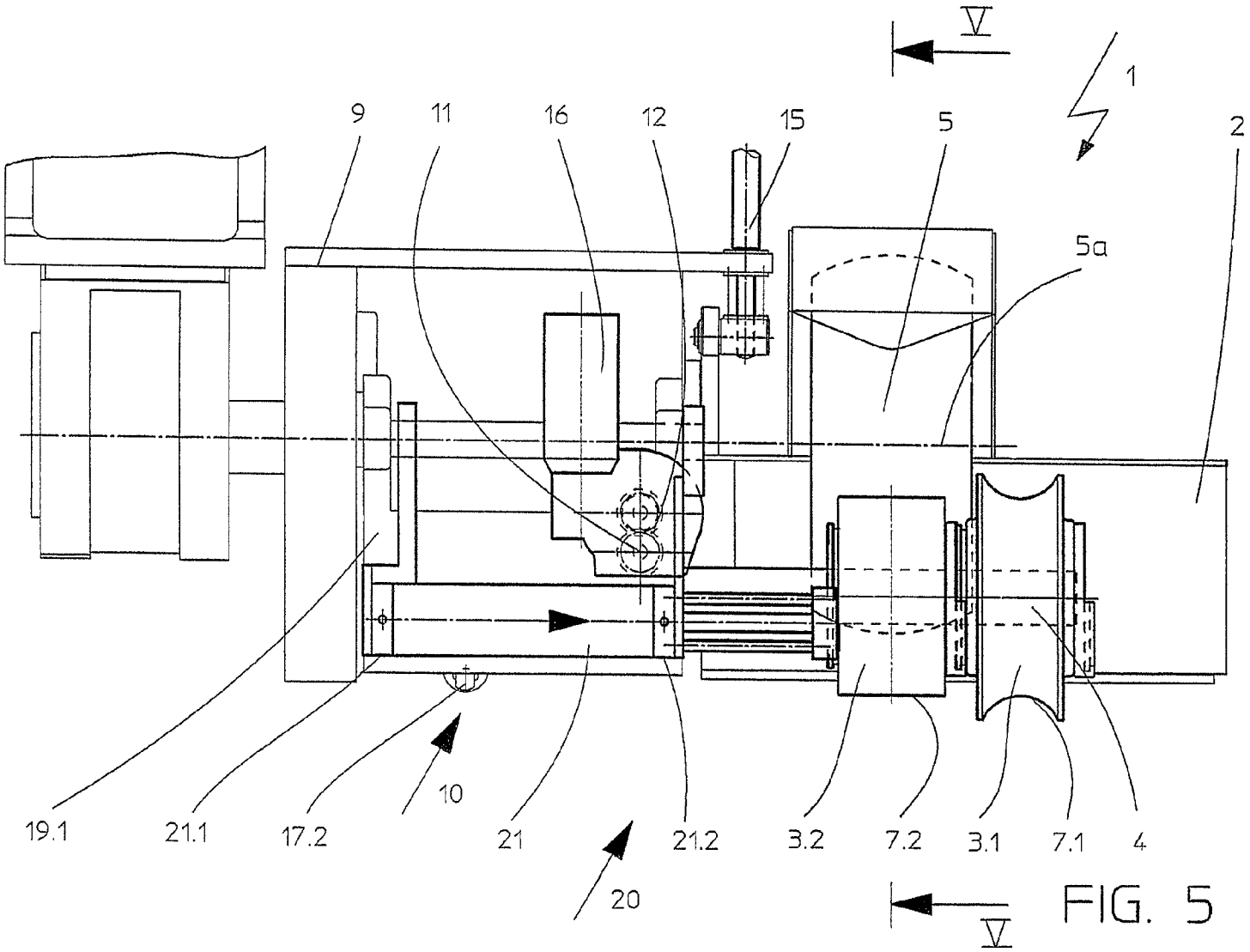
FIG. 5 A view of the front of the inventive apparatus, wherein a second application roller is aligned with the duct roller.

FIGS. 1 and 5 show views of the front of the apparatus 1, wherein respectively a different application roller 3.1, 3.2 is arranged aligned with the duct roller 5. FIGS. 2, 3, 4 and 6, on the other hand, show sectional views through the rotational axes of components of the apparatus 1.

Even though neither the book block nor the transporting device are shown explicitly, a transporting device as well as the position of the book block spine follow explicitly from the Figures as a result of the conveying direction 8 and the lower edge of the respective glue-application roller which are shown therein.

The two application rollers 3.1, 3.2 are embodied differently, meaning the first application roller 3.1 has a rounded outer surface 7.1 while the second application roller 3.2 has a flat outer surface 7.2. Of course, depending on the book blocks to be processed, application rollers with differently embodied outer surfaces as well as application rollers with the same or a different size can also be used. The apparatus 1 can furthermore also be provided with more than two application rollers. The respective combination of the application rollers only covers a specific range of book block thicknesses and shapes. If this range is exceeded, the apparatus 1 is provided with a new combination of application rollers for which the adjustment takes place in the same way as for the previous one.

The apparatus 1 furthermore comprises an adjustment mechanism 10, which is operatively connected to a machine control 13, for moving the respective application roller 3.1; 3.2 toward and/or away from the duct roller 5. The adjustment mechanism 10 comprises a first adjustment element 17 which is provided with a pneumatic cylinder 17*a* that is essentially arranged below the glue container 2 and is oriented along the conveying direction 8. Of course, a different suitable design as well as a different arrangement of the first adjustment element 17 is possible, for example with the aid of a non-depicted, buffered eccentric or cam for moving the respective application roller 3.1; 3.2 toward the duct roller 5 and/or away from the duct roller 5.

The drive shaft 4 for the application rollers 3.1 and 3.2 is positioned rotating inside a first leg 19.1 of a swivel frame 9 which is located in the basic frame 6. Accordingly, the swivel frame 9 and the drive shaft 4 for the application rollers 3.1, 3.2 have respectively one axis of rotation 9*a*, 4*a* which are arranged so as to be spaced apart. Depending on the actual adjustment of the first adjustment element 17, these two axes 9*a*, 4*a* are positioned more or less precisely one above the other in the vertical direction. For example, if the first application roller 3.1 is swiveled against the duct roller 5, then the axis of rotation 4*a* of the first application roller 3.1 is positioned precisely vertically below the axis of rotation 9*a* of the swivel frame 9 (see FIGS. 2 and 4).

Figure 6:
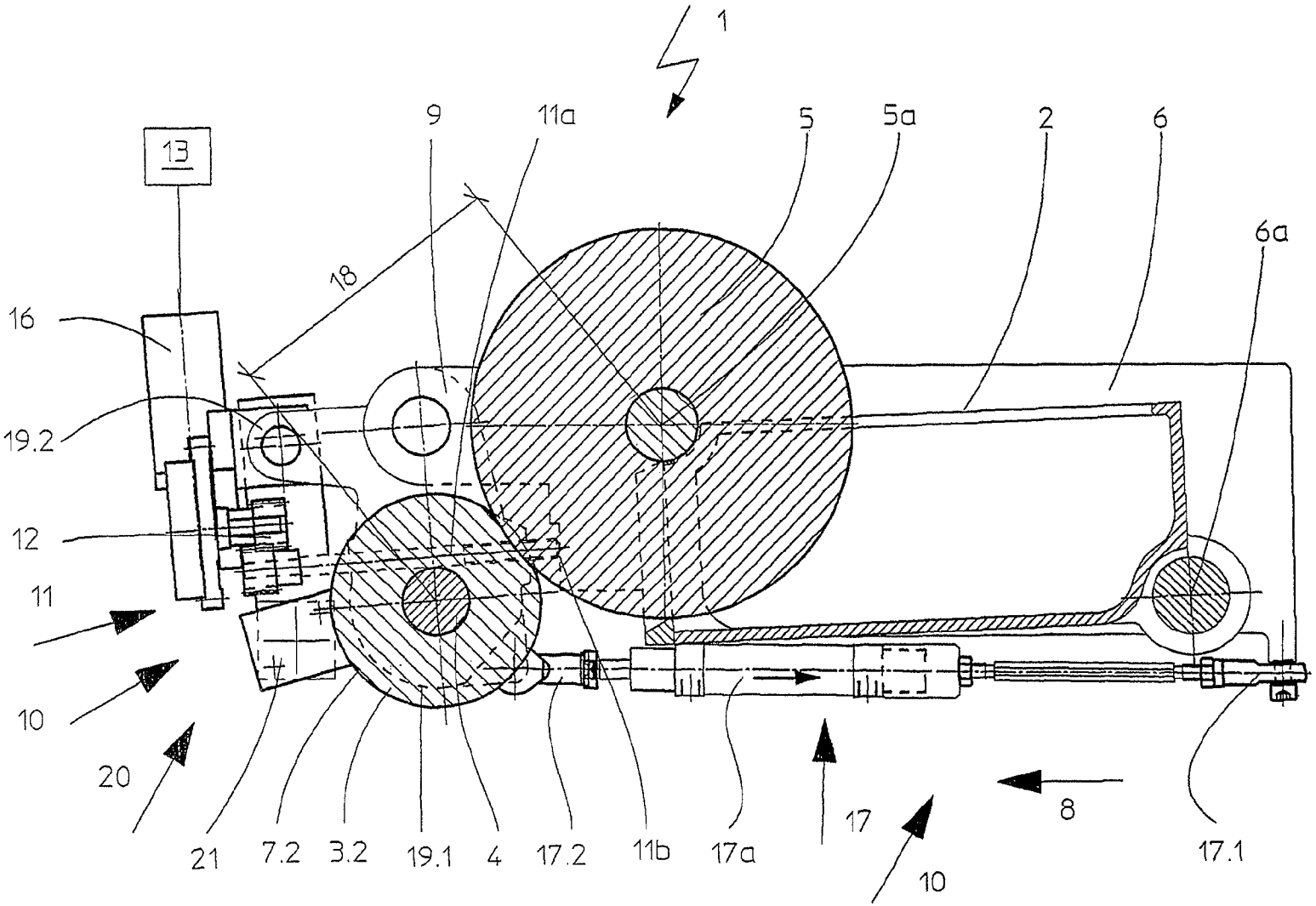
FIG. 6 A section along the line VI-VI in FIG. 5.

The swivel frame 9 also comprises a second leg 19.2, which is positioned facing away from the glue container 2 and extending substantially in the conveying direction 8, on which a second adjustment element 11 of the adjustment mechanism 10 is positioned immovably, relative to the swivel frame, but such that it can be moved along with the swivel frame 9. The second adjustment element 11 comprises a spindle 11*a*, essentially oriented in the conveying direction 8, for adjusting a spacing or distance 18 between the axis 5*a* of the duct roller 5 and the axis 4*a* of the respective application roller 3.1, 3.2 that is in contact with the duct roller (FIGS. 4 and 6). The second adjustment element 11 is driven with the aid of an adjustment drive 16 and is operatively connected to the adjustment drive 16 via a gear 12 that is also arranged on the second leg 19.2 of the frame 9. An output side end 11*b* of the second adjustment element 11 is embodied such that it can be supported on the basic frame 6 (FIGS. 2, 4 and 6). For adjusting the spacing 18 between the duct roller 5 and the respective application roller 3.1, 3.2 in contact with the duct roller, the machine control 13 of the apparatus 1 which acts upon the adjustment drive 16 specifies an adjustment distance for the second adjustment element 11. This adjustment distance is selected based on the respectively used application roller 3.1, 3.2 and the respective book block to be processed.

The pneumatic cylinder 17*a* is attached with a first end 17.1 to the basic frame 6. With a second end 17.2, which is oriented toward the application rollers 3.1 and 3.2, the pneumatic cylinder 17*a* is connected to the first leg 19.1 of the swivel frame 9.

The two adjustment elements 17 and 11, meaning the pneumatic cylinder 17*a* and the spindle 11*a*, operate jointly and/or against each other. They comprise respectively one axis 17*c*, 11*c* for enclosing a variable adjustment angle 14 in a vertical plane through the conveying direction 8 (FIG. 3). The adjustment angle 14 is variable, so that the second adjustment element 11 can be swiveled together with the application rollers 3.1, 3.2. Different diameters for the application rollers 3.1, 3.2 are taken into consideration for the adjustment of the second element 11, so that the adjustment of the first element 17 remains independent thereof.

As soon as the output side end 11*b* of the spindle 11*a* comes to rest against the basic frame 6 during the swiveling of the respective application roller 3.1, 3.2 against the duct roller 5, a further swiveling of the application roller 3.1, 3.2 is delimited with the aid of the pneumatic cylinder 17*a*. For this, the stroke length of the pneumatic cylinder 17*a* is selected such that its cylinder piston 17*b* cannot reach the end position during the swiveling of the application roller 3.1, 3.2 against the duct roller 5 (FIGS. 2 and 3). The pneumatic cylinder 17*a* therefore acts as a pneumatic spring in this direction which adjusts the contact pressure between the application roller 3.1, 3.2 and the duct roller 5. The contact pressure for the application roller 3.1, 3.2 can additionally be adjusted to be variable by using a proportional valve 17*d*, or using a non-depicted pressure reducer.

Arranged downstream of the duct roller 5 is a device 20 for exchanging the application rollers 3.1, 3.2 which are arranged on a joint drive shaft 4, as seen in the conveying direction 8. That is to say, for the exemplary embodiment the exchanging device 20 is arranged to exchange the first application roller 3.1 with the second application roller 3.2. The exchanging device 20 comprises an adjustment drive 21 that is embodied as double-stroke cylinder. A first end 21.1 of the adjustment drive 21 engages in the frame 9 and a second end 21.2 of the adjustment drive 21 engages in the basic frame 6. For this, the individual stroke of the double-stroke cylinder is coordinated with the two axially displaceable application rollers 3.1, 3.2 so that these rollers can be displaced with a double stroke in the axial direction. Accordingly, the displacement of a combination of three application rollers is possible, for example, with a double stroke. Of course, an electric adjustment drive can also be used instead of a pneumatic drive, or also any other suitable adjustment drive.

Since the adjustment mechanism 21 for displacing the application rollers in the axial direction and the second adjustment element 11 of the adjustment mechanism for changing the spacing 18 between the application rollers are arranged on the swivel frame 9 of the apparatus 1, both can be rotated jointly together with the swivel frame 9 around its axis of rotation 9*a*. As a result, the adjustment drive 21 and the second adjustment element 11 are always ready for use and need not change positions, thereby resulting in a cost-effective solution which clearly reduces the expenditure for the exchanging to the next production order.

For the processing of a current book production order with the aid of the apparatus 1, the duct roller 5 removes glue from the glue container 2 and, while in the application position, transfers the glue in the form of a glue film to one of the application rollers 3.1, 3.2 that was previously moved against the duct roller 5. A glue gap, which is not shown herein, is adjusted for this between the duct roller 5 and the glue container 2.

The rotational directions of the respective application roller 3.1, 3.2 and the duct roller 5 are the same. The glue film is transferred during the application position from the outer surface 7.1, 7.2 of the respective application roller 3.1, 3.2 to the book block spine, wherein the book block and the section of the outer surface 7.1, 7.2 which is in contact with the book block spine both move in the conveying direction 8.

The first adjustment element 17 is used for swiveling the respective application roller 3.1, 3.2 against and/or away from the duct roller 5. The second adjustment element 11 functions to adjust the axial spacing 18 between the duct roller 5 and the respective application roller 3.1, 3.2. The machine control 13 in this case can preset an adjustment distance for the second adjustment element 11 and thus a corresponding adjustment distance for the respective application roller 3.1, 3.2, or can alternatively also specify a contact pressure between the duct roller 5 and the respective application roller 3.1, 3.2. This is advantageous because the duct roller 5 has a convex circumferential shape and the glue could therefore not be transferred completely without a corresponding adjustment of the application rollers 3.1, 3.2.

Since the machine control 13 has the information relating to the respectively used application rollers 3.1, 3.2 because of the format data available for the book blocks to be produced, the necessary spacing 18 as well as the corresponding contact pressure can advantageously be preset with the aid of the drives which are operatively connected to the machine control 13. The relatively significant difference between a flat and a round application roller can thus be compensated for, and an excessively high contact pressure avoided for the respective application roller 3.1, 3.2 which is tied to increased wear.

If an exchange of the application rollers 3.1, 3.2 becomes necessary for a new book production order that follows the currently processed book production order and, in particular, a therewith connected change in the book block format, the glue gap for the duct roller 5 is initially reduced to zero, in a manner known per se. Thus, the glue remaining on the application roller 3.1, 3.2 following the completion of an order for applying glue to book block spines is transferred to the duct roller 5 and from there back into the glue container 2. The application roller 3.1, 3.2 used so far is then swiveled away from the duct roller 5 with the aid of the first adjustment element 17 of the adjustment mechanism 10. Following this, the adjustment drive 21 correspondingly acts upon the exchanging device 20 and the application rollers 3.1 and 3.2 are displaced normal to the conveying direction 8 and thus in an axial direction, far enough so that the application roller 3.2, 3.1 needed for the following production order is in the required position, relative to the duct roller 5, meaning it is aligned with the duct roller 5. At the same time, the glue gap for the duct roller 5 is restored and the required axial spacing adjusted between the duct roller 5 and the new application roller 3.2, 3.1. Subsequently, the application rollers 3.1, 3.2 are again swiveled against the duct roller 5 with the aid of the first adjustment element 17, so that the apparatus 1 is ready for operation within a short time and without manual intervention into the following production order so that glue can be applied, for example, to book blocks having a different format.

For the exemplary embodiment, the adjustment drive 21 of the exchanging device 20 is shown in FIG. 1 in the retracted position and in FIG. 5 in the fully extended position. Accordingly, FIG. 1 shows the first application roller 3.1 aligned with the duct roller 5 and FIG. 5 shows the second application roller 3.2 aligned with the duct roller, so that glue can be applied to a book block with rounded spine as well as a book block with flat spine.

In FIG. 6, the second application roller 3.2 is in an application position where it has been swiveled against the duct roller 5 following and exchange of the application roller (3.1, 3.2). The spacing 18 in this case is selected such that the duct roller 5 depresses the outer surface 7.2 of the second application roller 3.2. The outer surface 7.2 in the process assumes the shape of the duct roller 5, so that the glue is transferred to the complete surface of the rotating roller 3.2 which is driven in the same direction.

The basic frame 6 of the device 1, which accommodates the glue container 2 and the duct roller 5, is provided with an upstream arranged swivel axis **6*a*. With the aid of this swivel axis 6*a* and an additional adjustment drive 15, the glue container 2 can be raised and/or lowered (FIGS. 1 and 5). The glue gap to the duct roller 5 can thus be adjusted via an additional adjustment drive 15**.

It will be understood that the above description of the present invention is susceptible to various modifications, changes and adaptations, and the same are intended to be comprehended within the meaning and range of equivalents of the appended claims.

What is claimed is:

1. An apparatus to exchange an application roller which is aligned with a duct roller having an axis of rotation and which is used to apply glue to a spine of a book block by rolling off the book block spine, the book block being transported in a conveying direction and the duct roller removing glue from a glue container to transfer the glue to the application roller, the apparatus comprising:

at least two application rollers axially spaced apart, relative to each other, wherein a first one of the at least two application rollers is arranged to be in an initial position aligned and in contact with the duct roller, the at least two application rollers each having an axis of rotation separate from the axis of rotation of the duct roller, and the axis of rotation respectively of the duct roller and each of the at least two application rollers is substantially normal to the conveying direction; and a device to exchange the first one of the application rollers with a second one of the application rollers, wherein the device is configured to move the first one of the application rollers away from the duct roller, to subsequently axially move the at least two application rollers to exchange the first application roller with the second one of the application rollers so that the second one of the application rollers is aligned with the duct roller in place of the first one of the application rollers, and thereafter to move the second one of the application rollers against the duct roller.

2. The apparatus according to claim 1, wherein the device comprises a machine control for the apparatus and an adjustment mechanism connected to at least one of the application rollers and operatively connected to the machine control to move the application rollers away from and toward the axis of rotation of the duct roller.

3. The apparatus according to claim 2, wherein the adjustment mechanism comprises first and second adjustment elements that operate jointly.

4. The apparatus according to claim 3, wherein the first adjustment element includes a pneumatic cylinder and the second adjustment element includes a spindle having an output side end which is supported on a basic frame of the apparatus.

5. The apparatus according to claim 4, wherein the pneumatic cylinder comprises a cylinder axis and the spindle comprises a spindle axis, and the cylinder and spindle axes together enclose a variable adjustment angle in a vertical plane through the conveying direction.

6. The apparatus according to claim 1, wherein the application rollers are arranged coaxially and are moveable along a joint axis of rotation.

7. The apparatus according to claim 6, further including a joint drive shaft, wherein the application rollers are arranged displaceable in a longitudinal direction on the joint drive shaft.

8. The apparatus according to claim 1, wherein the respective application roller that is aligned with the duct roller is arranged to be swiveled toward the duct roller and away from the duct roller.

9. The apparatus according to claim 3, further comprising a basic frame and a swivel frame having an axis of rotation and first and second legs, wherein the application rollers are positioned to swivel in the swivel frame, and wherein the first leg of the swivel frame is connected to the first adjustment element and the second leg of the swivel frame is connected to the second adjustment element.

10. A book production line comprising the apparatus according to claim 1.

11. A method for exchanging an application roller which is aligned with a duct roller having an axis of rotation and which is used to apply glue to a spine of a book block by rolling off the book block spine, wherein the book block is transported in a conveying direction and the duct roller removes glue from a glue container to transfer the glue to the application roller, the method comprising:

providing an apparatus to exchange an application roller according to claim 1;

arranging the at least two application rollers spaced apart, relative to each other, with a first one of the at least two application rollers being positioned aligned and in contact with the duct roller, wherein the duct roller and the at least two application rollers each have an axis of rotation that is positioned substantially normal to the conveying direction; and moving the application rollers in an axial direction with the aid of the exchanging device, such that a second one of the application rollers is moved into alignment with and against the duct roller in place of the first one of the application rollers.

12. The method according to claim 11, wherein the moving step includes initially moving the first one of the application rollers away from the duct roller and subsequently moving the application rollers in the axial direction until the second one of the application rollers is aligned with the duct roller, and finally moving the second one of the application rollers against the duct roller.

13. The method according to claim 12, wherein the initial moving step includes adjusting an axial distance between the axis of the duct roller and the axis of the second one of the application rollers when moving the second one of the application rollers against the duct roller using a machine control issuing a signal corresponding to the axial distance.

14. The method according to claim 12, further including adjusting a contact pressure between the second one of the application rollers and the duct roller in addition to adjusting the axial spacing distance.

* * * * *

UNITED STATES PATENT AND TRADEMARK OFFICE

CERTIFICATE OF CORRECTION

PATENT NO. : 9,375,969 B2
APPLICATION NO. : 13/779345
DATED : June 28, 2016
INVENTOR(S) : Hans Mueller It is certified that error appears in the above-identified patent and that said Letters Patent is hereby corrected as shown below:

TITLE PAGE

(73) Assignee should read: MUELLER MARTINI HOLDING AG
Hergiswil (CH)

Signed and Sealed this
Sixteenth Day of August, 2016

Michelle K. Lee

Michelle K. Lee
*Director of the United States Patent and Trademark Office*